United States Patent [19]

Suzuki

[11] Patent Number: 4,862,783

[45] Date of Patent: Sep. 5, 1989

[54] TONE CONTROL DEVICE FOR AN ELECTRONIC MUSICAL INSTRUMENT

[75] Inventor: Satoshi Suzuki, Hamamatsu, Japan

[73] Assignee: Yamaha Corporation, Hamamamtsu, Japan

[21] Appl. No.: 323,102

[22] Filed: Mar. 14, 1989

Related U.S. Application Data

[63] Continuation of Ser. No. 210,795, Jun. 24, 1988, abandoned.

[30] Foreign Application Priority Data

Jun. 26, 1987 [JP] Japan ..... 62-158934
Jun. 26, 1987 [JP] Japan ..... 62-158935

[51] Int. Cl.[4] ..... G10H 1/057; G10H 1/14

[52] U.S. Cl. ..... 84/622; 84/627; 84/DIG. 2

[58] Field of Search ..... 84/1.11–1.13, 84/1.19–1.27, DIG. 2, DIG. 9

[56] References Cited

U.S. PATENT DOCUMENTS

| | | | |
|---|---|---|---|
| Re. 30,834 | 12/1981 | Niimi et al. | 84/1.19 X |
| 3,603,713 | 9/1971 | Nakada | 84/1.19 |
| 3,935,781 | 2/1976 | Katoh et al. | 84/1.11 |
| 3,973,461 | 8/1976 | Jahns | 84/1.11 X |
| 3,992,969 | 11/1976 | Robinson et al. | 84/1.11 X |
| 3,999,458 | 12/1976 | Suzuki | 84/1.19 X |
| 4,159,663 | 7/1979 | Aoki et al. | 84/1.11 X |
| 4,176,577 | 12/1979 | Yamada et al. | 84/1.19 X |
| 4,178,824 | 12/1979 | Aoki et al. | 84/1.19 |
| 4,213,366 | 7/1980 | Niimi et al. | 84/1.19 X |
| 4,706,537 | 11/1987 | Oguri | 84/1.19 X |

*Primary Examiner*—Stanley J. Witkowski
*Attorney, Agent, or Firm*—Spensley Horn Jubas & Lubitz

[57] ABSTRACT

A tone color of a tone to be generated is selected by a tone color selection switch and various parameters for realizing the selected tone color are generated. There are provided a first operator for designating a fine adjustment in a predetermined direction (e.g., increasing direction) with respect to a predetermined tone color determining element and a second operator for designating a fine adjustment in a direction opposite to the direction (e.g., decreasing direction) with respect to the predetermined tone color determining element. Operation data concerning the predetermined tone color determining element is formed in accordance with operations of the first and second operators. A parameter associated with the predetermined tone color determining element among the parameters for realizing the selected tone color is changed in accordance with this operation data. A tone signal generation circuit generates, in response to given tone pitch information and the tone color parameter, a tone signal corresponding to this tone pitch information with a tone color established by the tone color parameter. Therefore, fine adjustment of the tone color is achieved by merely operating one of the first and second operators corresponding to a desired direction of fine adjustment.

15 Claims, 8 Drawing Sheets

| | |
|---|---|
| OTCNO | ORCHESTRA SYSTEM SELECTED TONE COLOR NO. |
| OBMCTR | ORCHESTRA SYSTEM BRIGHT/MELLOW COUNTER |
| OFSCTR | ORCHESTRA SYSTEM FAST/SLOW COUNTER |
| ORCON | ORCHESTRA ON DATA |
| OBUFM | ORCHESTRA SYSTEM TONE COLOR DATA BUFFER MEMORY |
| STCNO | SOLO SYSTEM SELECTED TONE COLOR NO. |
| SBMCTR | SOLO SYSTEM BRIGHT/MELLOW COUNTER |
| SFSCTR | SOLO SYSTEM FAST/SLOW COUNTER |
| SOLON | SOLO ON DATA |
| SBUFM | SOLO SYSTEM TONE COLOR DATA BUFFER MEMORY |
| OTHER DATA MEMORIES | |

DATA & WORKING RAM 13

FIG. 7

TONE CONTROL DEVICE FOR AN ELECTRONIC MUSICAL INSTRUMENT

This is a continuation of copending application Ser. No. 210,795 filed on June 2, 1988 and now abandoned.

BACKGROUND OF THE INVENTION

This invention relates to a tone control device for an electronic musical instrument capable of subtly changing a tone color parameter once selected as desired by the performer and, more particularly, to a tone control device of this type in which an operation for adjusting the tone color can be readily made even during performance of music.

This invention relates also to an electronic musical instrument of a type in which tone signals corresponding to tone pitches designated by depression of keys are generated in two tone generation systems and the tone colors of tone signals generated in the respective systems are selected independently from each other system and, more particularly, to an electronic musical instrument of this type capable of controlling generation and cease of a tone in one tone generation system in accordance with a tone color selection operation in the other tone generation system .

In conventional electronic musical instruments, fine adjustment of the tone color is achieved by operating a volume type operator such as a brilliance operator.

In the volume type operator, the amount of fine adjustment of the tone color is determined in correspondence to operated position of the operator and, accordingly, the operator must be manipulated accurately to the operated position corresponding to a desired fine adjustment amount. It is however very difficult to manipulate the volume type operator accurately to the operated position corresponding to the desired fine adjustment amount while playing on the keyboard.

There has been known an electronic musical instrument in which tone signals corresponding to tone pitches designated by depression of keys are generated in plural tone generation systems and the tone colors of the tone signals generated in the respective tone generation systems are selected independently from each other system. In such prior art electronic musical instrument, a tone sounding selection switch for selecting whether a tone signal is to be generated or not in each tone generation system is provided individually in each system and generation or nongeneration of a tone signal in each system is controlled by switching on and off of each tone sounding selection switch.

This necessitates provision of tone sounding selection switches in the number corresponding to the number of the tone generation systems with resulting requirement for a complicated circuit design and high cost of manufacture.

In a case where, during performance of music, a certain system which is in a state capable of generating a tone is to be switched to a state incapable of generating a tone and, at the same time, another system which is in a state incapable of generating a tone is to be switched to a state capable of generating a tone, i.e., a system in which a tone is generated is to be switched from one system to another, the operation for turning off the tone sounding selection switch in the former system and the operation for turning on the tone sounding selection switch in the latter system must be made almost simultaneously and besides the tone color selection operation in the latter system , i.e., the system in which a tone is to be generated anew, must also be made. This requires extremely complicated switching operations in switching the tone generation system with resulting occurrence of difficulty in the performance of music.

Further, in a case where a system which is in a state incapable of generating a tone is to be switched to a state capable of generating a tone in addition to a system which is in a state capable of generating a tone thereby sounding tones in the two systems, the operation for turning on the tone sounding selection switch in the latter system and the operation for selecting a desired tone color in that system must be made almost simultaneously with resulting requirement for very complicated switching operations.

SUMMARY OF THE INVENTION

It is, therefore, a first object of the invention to provide a tone control device for an electronic musical instrument capable of making an operation for subtly adjusting the tone color very easily even during performance of music.

It is a second object of the invention to provide an electronic musical instrument in which the tone sounding selection switches for the respective tone generation systems for selecting whether a tone signal is to be generated or not are obviated by controlling, in association with operation of a tone color selection switch in each tone generation system , whether or not a tone signal is to be generated in a tone generation system corresponding to the operated tone color selection switch and also in other tone generation system whereby selection of whether a tone signal is to be generated or not in each tone generation system can be readily performed.

For achieving the first object of the invention, the tone control device for an electronic musical instrument according to the invention comprises tone color selection means for selecting a tone color of a tone to be generated, tone color parameter generation means for generating tone color parameters for realizing the tone color selected by said tone color selection means, tone signal generation means for generating, in accordance with given tone pitch information and the tone color parameters, a tone signal corresponding to this tone pitch information with a tone color established by the tone color parameters, first operator means for designating a fine adjustment in a predetermined direction with respect to a predetermined tone color determining element, second operator means for designating a fine adjustment in a direction opposite to said direction with respect to said predetermined tone color determining element, operation data forming means for forming operation data concerning said predetermined tone color determining element in response to operation of said first and second operator means, and control means for changing, in accordance with the operation data formed by said operation data forming means, a tone color parameter associated with said predetermined tone color determining element among the tone color parameters generated by said tone color parameter generation means.

There are provided the first operator means for designating a fine adjustment in a predetermined direction with respect to a predetermined tone color determining element and the second operator means for designating a fine adjustment in a direction opposite to the direction of the first operator means with respect to the predetermined tone color determining element. For example, the first operator means is used for designating increase of the fine adjustment amount concerning the predetermined tone color determining element and the second operator means is used for designating decrease of the fine adjustment amount concerning the predetermined tone color determining element. The operation data forming means forms operation data concerning the predetermined tone color determining element in accordance with the operations of the first and second operator means. The control means changes, in accordance with the operation data formed by the operation data forming means, a tone color parameter associated with the predetermined tone color determining element among the tone color parameters generated by the tone color parameter generation means. Thus, in accordance with the operations of the first and second operator means, the tone color parameter associated with the predetermined tone color determining element is finely adjusted whereby the tone color of the tone signal is finely adjusted.

The operations of the first and second operator means themselves do not correspond to absolute amount of operation or absolute amount of fine adjustment but merely designate relative direction (extending) of fine adjustment. Accordingly, accurate position control is not required at all but mere operation of one of the operator means corresponding to a desired direction of fine adjustment will suffice. This greatly facilitates the operation for finely adjusting the tone color, enabling the performer to finely adjust the tone color easily even during performance of music.

In the embodiments to be described below, the ratio of content of harmonic components in a tone signal is taken for example of the predetermined tone color determining element. In this case, the first operator means consists of a bright switch for designating a direction in which the ratio of content of harmonic components increases and the second operator means consists of a mellow switch for designating a direction in which the ratio of content of harmonic components decreases. For another example of the predetermined tone color determining element, rise characteristics of a tone are used. In this case, the first operator means consists of a fast switch for designating quickening of rising of the tone and the second operator means consists of a slow switch for designating slowing of rising of the tone.

For achieving the second object of the invention, the electronic musical instrument according to the invention comprises a first tone generation system generating, in accordance with one or more given tone pitch information, a tone signal or signals corresponding to the tone pitch information, a second tone generation system generating, in accordance with one or more given tone pitch information, a tone signal or signals corresponding to the tone pitch information, first tone color selection means for selecting a tone color of a tone signal generated by said first tone generation system , second tone color selection means for selecting a tone color of a tone signal generated by said second tone generation system , operation detection means for detecting, in response to an output of said respective tone color selection means, (a) whether or not a tone color selection operation has been made substantially simultaneously in both said first and second tone color selection means and (b) whether or not a tone color selection operation has been made only in one of said first and second tone color selection means, and control means responsive to the detection by said operation detection means for (a) enabling both said first and second tone generation systems to generate a tone when the tone color selection operation has been made substantially simultaneously both in said first and second tone color selection means and, (b) enabling only one of said first and second tone generation systems corresponding to the tone color selection means in which the tone color selection operation has been made to generate a tone and prohibiting the other tone generation system from generating a tone when the toe color selection operation has been made in only one of said first and second tone color selection means.

The operation detection means detects (a) whether or not a tone color selection operation has been made substantially simultaneously in both the first and second tone color selection means and (b) whether or not a tone color selection operation means has been made only in one of the first and second tone color selection means. The control means effects control, in response to the detection by the operation detection means, for (a) enabling both the first and second tone generation systems to generate a tone when the tone color selection operation has been made substantially simultaneously both in the first and second tone color selection means ad, (b) enabling only one of the first and second tone generation systems corresponding to the tone color selection means in which the tone color selection operation has been made to generate a tone and prohibiting the other tone generation system from generating a tone when the tone color selection operation has been made in only one of the first and second tone color selection means.

Accordingly, if the tone color selection operation is performed only in the first tone color selection means, this corresponds to the operation (b) so that the first tone generation system only becomes capable of generating a tone whereas the second tone generation channel becomes incapable of generating a tone. If, accordingly, a tone was being sounded from the second tone generation system until then, the sounding of the tone is automatically stopped and, instead, a tone according to the newly selected tone color is sounded from the first tone generation system .

When the tone color selection operation is made only in the second tone color selection means, this corresponds likewise to the operation (b) so that the second tone generation system only becomes capable of generating a tone whereas the first tone generation system becomes incapable of generating a tone. If, accordingly, a tone was being sounded from the first channel until then, the sounding of the tone is automatically stopped and, instead, a tone according to the newly selected tone color is sounded from the second tone generation system .

When the tone color selection operation is made substantially simultaneously both in the first and second tone color selection means, this corresponds to the operation (a) so that a tone can be generated both in the first and second tone generation systems Therefore, tones according to the tone colors newly selected by the first and second tone color selection means in correspondence to the respective systems are generated respectively from the first and second tone generation systems In the above described manner, in association with the tone color selection operation of the tone color selection means corresponding to the respective tone generation systems whether or not a tone can be generated in the tone generation system corresponding to the tone color selection means and in the other tone generation system is controlled and, accordingly, provision of particular tone sounding selection switches for the respective tone generation systems for selecting whether a tone signal should be generated or not is obviated whereby the construction of the tone control device can be simplified and, moreover, the selection of whether a tone signal can be generated or not in the respective tone generation systems can be performed very easily even during performance of music.

Embodiments of the invention will now be described with reference to the accompanying drawings.

BRIEF DESCRIPTION OF THE DRAWINGS

In the accompanying drawings,

FIG. 7 is a diagram showing an example of contents stored in a data and working RAM;

DESCRIPTION OF PREFERRED EMBODIMENTS

Figure 1A:
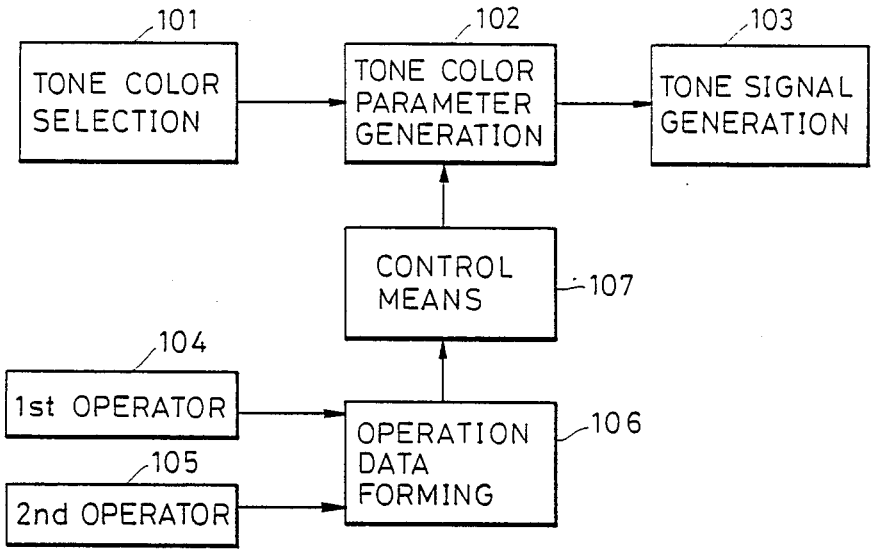
FIG. 1 in is a functional block diagram showing an embodiment of the tone control device according to the invention.
FIG. 1B is a functional block diagram showing an embodiment of a tone control between the tone generation systems according to the invention.

FIG. 1A is a functional block diagram showing schematically an embodiment of the electronic musical instrument according to the invention capable of subtly changing a tone color parameter once selected as desired by the performer.

Tone color selection means 101 is provided for selecting a tone color of a tone to be generated. Tone color parameters for realizing a tone color selected by this tone color selection means 101 are generated by tone color parameter generation means 102. Tone signal generation means 103 generates, in accordance with given tone pitch information and the tone color parameters, a tone signal corresponding to the given tone pitch with a tone color established by the tone color parameters. There are provided first operator means 104 for designating a fine adjustment in a predetermined direction with respect to a predetermined tone color determining element and second operator means for designating a fine adjustment in a direction opposite to the direction with respect to the predetermined tone color determining element. The first operator means 104 designates, for example, increase of fine adjustment amount concerning the predetermined tone color determining element and the second operator means 105 designates decrease of fine adjustment amount concerning the predetermined tone color determining element. Operator data forming means 106 forms operation data concerning the predetermined tone color determining element in response to operation of the first and second operator means 104 and 105. Control means 107 changes, in accordance with the operation data formed by the operation data forming means 106, a tone color parameter associated with the predetermined tone color determining element among the tone color parameters generated by the tone color parameter generation means 102.

Thus, the tone color parameter associated with the predetermined tone color determining element is finely adjusted by the operations of the first operator means 104 and the second operator means 105 whereby the tone color of the tone signal is finely adjusted. The operations of the first and second operator means 104 and 105 do not correspond to absolute amount of operation or absolute amount of fine adjustment but merely designate relative direction of fine adjustment. An accurate position control is not required at all but mere operation on one of the operator means corresponding to a desired direction of fine adjustment will suffice. The operation for fine adjustment of the tone color thereby is greatly facilitated and the operation for subtly adjusting the tone color can be made easily even during performance of music.

Figure 1B:
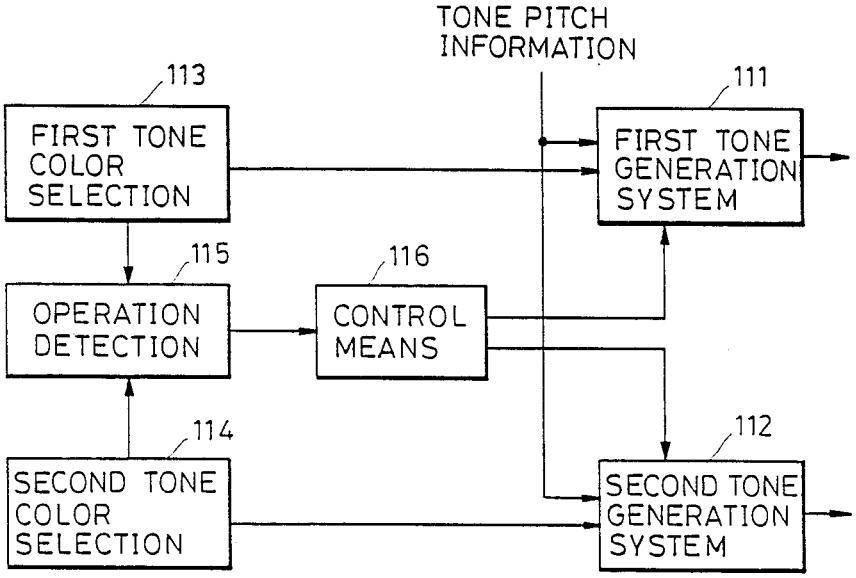

FIG. 1B is a functional block diagram showing schematically an embodiment of the electronic musical instrument according to the invention capable of generating tone signals corresponding to given tone pitches in two tone generation systems and controlling sounding and cease of a tone in one tone generation channel in accordance with tone color selection operation in the other tone generation system .

First and second tone generation systems 111 and 112 generate, in accordance with one or more given tone pitch information, tone signals corresponding to the tone pitch information. A tone color of a tone signal generated by the first tone generation system 113 is selected by first tone color selection means 113 and a tone color of a tone signal generated by the second tone generation system 112 is selected by second tone color selection means 114. Thus, tone signals corresponding to the same tone pitch information are generated with different tone colors.

Operation detection means 115 detects, in response to an output of the respective tone color selection means 113 and 114, (a) whether or not a tone color selection operation has been made substantially simultaneously in both the first and second tone color selection means or (b) whether or not a tone color selection operation has been made only in one of the first and second tone color selection means 113 and 114.

Control means 116 effects control, responsive to the detection by the operation detection means 115, for (a) enabling both the first and second tone generation systems 111 and 112 to generate a tone when the tone color selection operation has been made substantially simultaneously both in the first and second tone color selection means 113 and 114, whereas (b) enabling only one of the first and second tone generation systems 111 and 112 corresponding to the tone color selection means 113 and 114 in which the tone color selection operation has been made to generate a tone and prohibiting the other tone generation channel from generating a tone when the tone color selection operation has been made in only one of the first and second tone color selection means 113 and 114.

Figure 2:
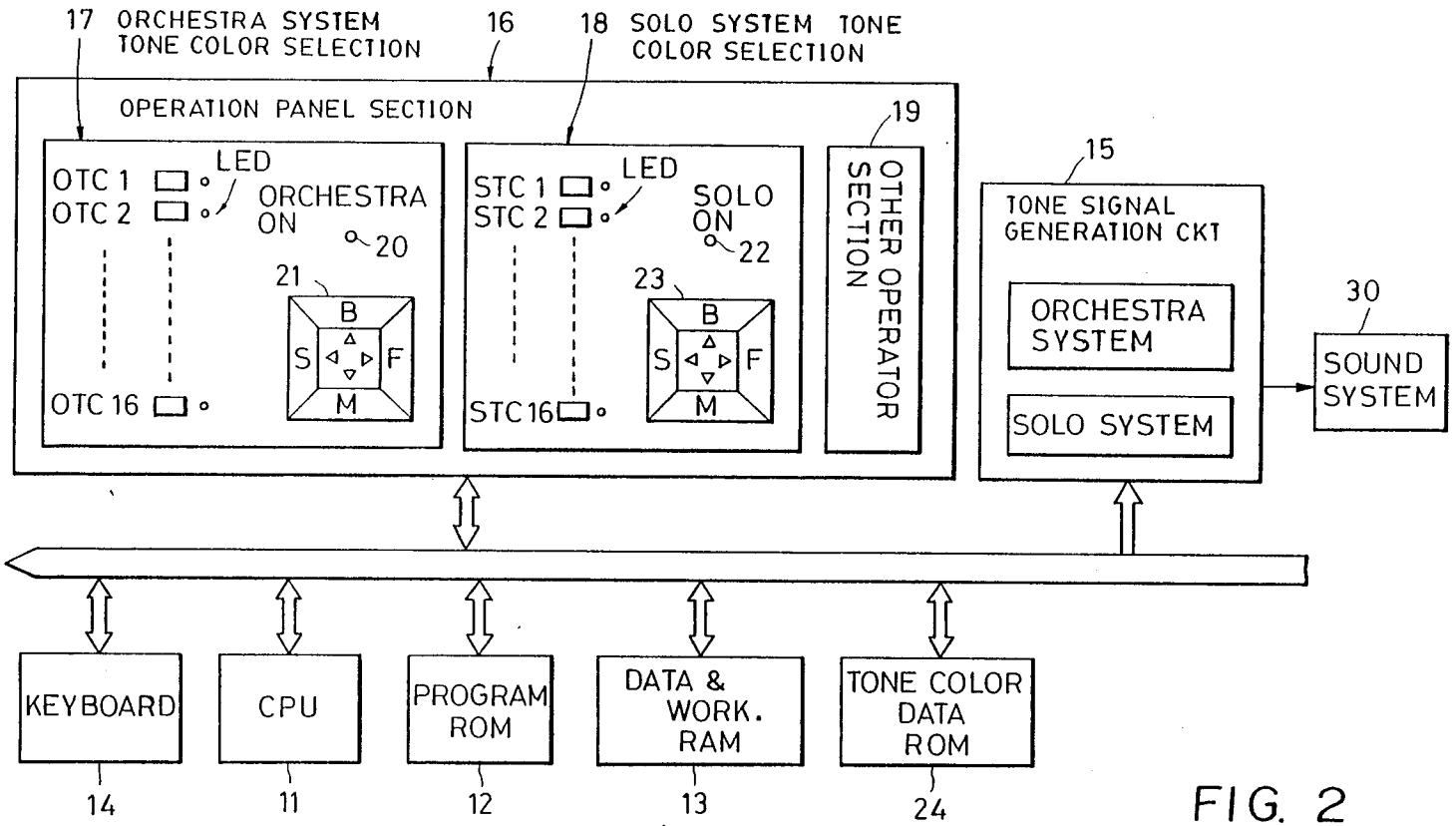
FIG. 2 is a diagram showing a hardware structure of an embodiment of the electronic musical instrument according to the invention.

FIG. 2 shows a hardware construction of an embodiment of the electronic musical instrument made according to the invention. In the electronic musical instrument of this embodiment, various operations and processings are controlled by a microcomputer including a CPU (central processing unit) 11, a program ROM (read-only memory) 12 and a data and working RAM (random-access memory) 13.

A keyboard 14 comprises a plurality of keys for designating tone pitches of tones to be generated. A key scanning processing for detecting on/off states of key switches for respective keys in the keyboard 14 is executed by the microcomputer so that sounding of tones corresponding to depressed keys is assigned to any one or more of tone generation systems A tone signal generation circuit 15 generates, on the basis of information of depressed keys and tone control information for setting tone color etc, tone signals having tone pitches corresponding to the depressed keys with characteristics controlled in accordance with the tone control information. This tone signal generation circuit 15 has two tone generation systems One of them has plural tone generation channels capable of generating tone signals corresponding to plural depressed keys. This tone generation system is conveniently called "orchestra system" herein. The other tone generation system has a single tone generation channel and is capable of generating a tone signal corresponding to a single key which has been selected in accordance with a predetermined standard among the depressed keys. This tone generation system is conveniently called "solo system". In the "orchestra system" and "solo system", selection and setting of a tone color can be made independently from each other. Parallel tone signal generation hardware circuits may be provided for the "orchestra system" and "solo system" or, alternatively, a common tone signal generation hardware circuit may be used on a time shared basis. Tone signals provided by the tone signal generation circuit 15 are supplied to a sound system 30.

An operation panel section 16 comprises an orchestra system tone color selection section 17, a solo system tone color selection section 18 and other operator section 19 including various switches and operator means for tone setting and controlling purposes.

The orchestra system tone color selection section 17 comprises orchestra system tone color selection switches OTC1–OTC16, light-emitting diodes (abbreviated as LED) provided in correspondence to the respective tone color selection switches OTC1–OTC 16, an orchestra ON display light-emitting diode 20 which is lighted when the "orchestra system" can generate a tone and a tone color adjusting operator means 21 for finely adjusting tone colors of the "orchestra system".

The tone color adjusting operator means 21 comprises four tone color adjusting switches B, M, F and S. The key top of the tone color adjusting operator means 21 is of a regular truncated pyramid configuration and the four gradual slopes of this key top constitute the operators of the tone color selection adjusting switches B, M, F and S. The respective slopes are marked with letters "B", "M", "F" and "S" representing respectively the tone color adjusting switches B, M, F and S. Accordingly, by depressing one of the slopes of the key top of the tone color adjusting operator means 21, one of the tone color adjusting switches B, M, F and S corresponding to the depressed slope is turned on.

The tone color adjusting switches B, M, F and S are arranged in such a manner that opposite ones of these switches form pairs. More specifically, the tone color adjusting switches B and M form a pair and the tone color adjusting switches F and S form another pair. The tone color adjusting switches forming a pair designate control states which are opposite to each other with respect to a certain tone control element. For example, the tone color adjusting switches B and M designate control states opposite to each other with respect to the ratio of content of harmonic components of a tone signal, i.e., one tone color adjusting switch (bright switch) B designates increase of harmonic components so as to realize a bright tone color whereas the other tone color adjusting switch (mellow switch) M designates decrease of harmonic components so as to realize a mellow tone color. The tone color adjusting switches F and S designate opposite control states mainly with respect to rise characteristics of a tone, i.e., one tone color adjusting switch (fast switch) F designates quickening of rising of the tone so as to realize a sharp tone whereas the other tone adjusting switch (slow switch) S designates making rising of the tone more gradual so as to realize a soft tone.

The solo system tone color selection section 18 comprises, entirely in the same manner as the above described orchestra tone color selection section 17, solo channel tone color selection switches STC1–STC16, light-emitting diodes provided in correspondence to the respective tone color selection switches STC1–STC16, a solo ON display light-emitting diode 22 which is lighted when the "solo system" can generate a tone and a tone color adjusting operator means 23 for finely adjusting the tone color of the "solo system". The tone color adjusting operator means 23 for the solo system comprises, entirely in the same manner as the tone color adjusting operator means 21 of the orchestra channel, four tone color adjusting switches B, M, F and S, performing fine adjustment of the ratio of content of harmonic components contained in the tone signal by means of the bright switch B and the mellow switch M and performing mainly fine adjustment of the rise characteristics of the tone by means of the fast switch F and the slow switch S.

The orchestra system tone color selection section 17 and the solo system tone color selection section 18 should preferably be provided side by side. By this arrangement, the tone color selection switches OTC-1–OTC16 and STC1–STC16 of the two systems can be selected almost simultaneously with a single hand when an orchestra system tone color and a solo system tone color are to be selected simultaneously whereby operability is improved.

A tone color data ROM 24 is provided for storing tone color data realizing various tone colors and provides, in correspondence to the respective systems , required tone color data in accordance with tone color selection and adjusting operations in the orchestra system tone color selection section 17 and the solo system tone color selection section 18. The read out tone color data of the respective systems is supplied to the tone signal generation circuit 15 and is used therein for setting and controlling tone colors of tone signals generated in the "orchestra system" and "solo system". The type of data constituting tone color data differs depending upon the tone synthesis system in the tone signal generation circuit 15. If the tone synthesis system is one employing frequency modulation operation, parameters for the frequency modulation operation constitute the tone color data. Description will be made below with respect to a case where the frequency modulation operation system is employed as the tone synthesis system in the tone signal generation circuit 15.

The tone synthesis employing the frequency modulation operation system is well known in the art. For better understanding of one example of parameters constituting tone color control elements in this tone synthesis system, description will now be made about one example of such parameters.

Figure 3:
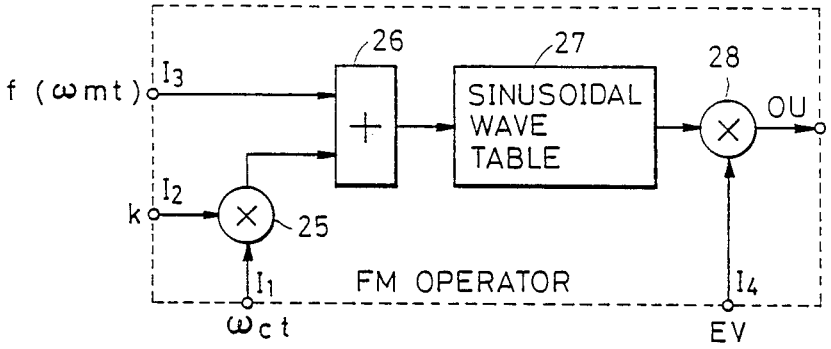
FIG. 3 is a block diagram showing an example of a basic construction of an FM operator which is a basic unit of a tone synthesis frequency modulation operation circuit.

FIG. 3 is a diagram showing an example of basic construction of an FM operator which is a basic unit of the frequency modulation operation circuit for tone synthesis. The FM operator comprises input terminals I1–I4, a multiplier 25, an adder 26, a sinusoidal wave table 27, a mulitplier 28 and an output terminal OU. To the input terminals I1–I4 are applied carrier wave phase angle data ωct, frequency ratio setting data k, modulating wave signal data f (ωmt) and envelope shape data EV. The multiplier 25 multiplies the carrier wave phase angle data ωct with the frequency ratio setting data k thereby variably controlling the frequency of the carrier wave in accordance with the frequency setting data k. The adder 26 adds the modulating wave signal data f (ωmt) to the carrier wave phase angle data k ct for which the frequency ratio has been established and thereby performs phase modulation of the carrier wave, i.e., frequency modulation. Sinusoidal wave amplitude sample data is read out from the sinusoidal wave table in response to the output of the adder 26 and, in accordance with the sample data, there is provided a signal obtained by frequency modulating the carrier wave signal corresponding to the carrier wave phase angle data k ωct with the modulating wave signal data (ωmt). The multiplier 28 multiplies the output signal of the sinusoidal wave table 27 with the envelope shape data EV and provides an output signal which has been controlled in amplitude envelope from its output terminal OU.

In one tone generation channel generating one tone signal, a plurality of FM operators of the above described type are connected together so that a multiplex FM operation formula or multi-term FM operation formula is realized and a tone signal of a desired tone color thereby is synthesized. By way of example, it is assumed that four FM operators are used in a tone signal generation channel generating one tone signal and these operators are named, for convenience's sake, M1, M2, C1 and C2. FIG. shows an example of connection of these four operators M1, M2, C1 and C2. As is known, the connection of the operators M1, M2, C1 and C2 can be changed as desired in accordance with a desired tone color. The connection of the operators means which output I4 should be connected to which modulating wave signal input I3. A circuit for changing this operator connection is not particularly shown here. As is known also, a single common FM operator hardware circuit may be used on a time shared basis instead of separately providing hardware circuits of the respective operators M1, M2, C1 and C2. Further, a single common FM operator hardware circuit may be used on a time shared basis among the respective tone generation channels instead of providing separate operator hardware circuits of the respective channels. Since these circuits are known, further explanation will be omitted.

Figure 4:
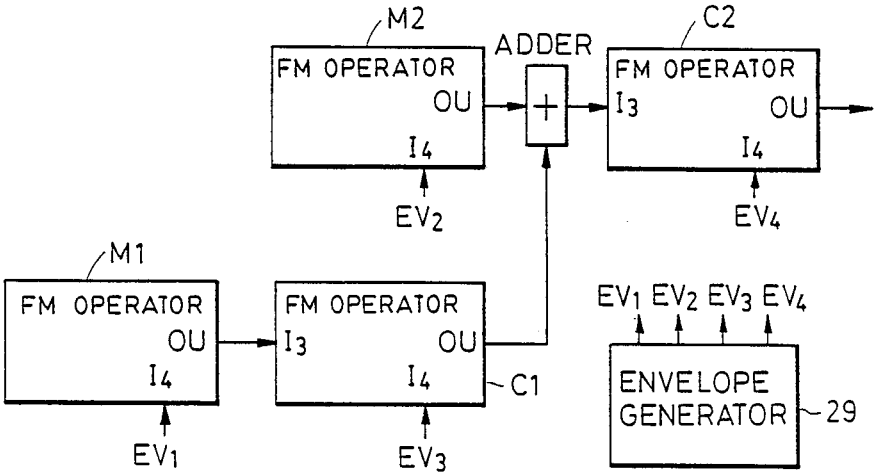
FIG. 4 is a block diagram showing an example of connection of four FM operators as shown in FIG. 3 in accordance with a desired FM operation formula.

In the FM operation system, various FM operation parameters (e.g., type of connection of the operators, frequency ratio setting data k for each of the operators M1, M2, C1 and C2 and envelope shape data EV). Particularly, the envelope shape EV has different meaning in determining the tone color depending upon whether its operator functions as modulating wave signal generation means or carrier wave signal generation means. The envelope shape data EV in an operator functioning as the modulating wave signal generation means functions as modulation index setting data. In the example shown in FIG. 4, the operators M1, M2 and C1 are the operators functioning as the modulating wave signal generation means. The envelope shape EV in an operator functioning as the carrier wave signal generation means functions as tone volume level setting data of a tone signal. In the example of FIG. 4, the operator C2 is this operator.

Figure 5:
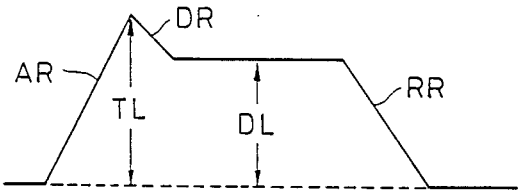
FIG. 5 is a diagram showing a typical example of envelope shape.

FM operation parameters participating to determination of the tone color are supplied in accordance with tone color data read out from the tone color data ROM 24. This tone color data includes data designating the type of connection of operators, frequency ratio setting data k for each of the operators M1, M2, C1 and C2 and envelope parameter data for setting the envelope shape. A typical example of the envelope shape is shown in FIG. 5. In FIG. 5, characteristics of attack, decay, sustain and release portions are determined by envelope parameter data including attack rate AR, total level TL, decay rate DR, decay level DL and release rate RR. As a part of the tone color data, such envelope parameter data are supplied to envelope generator 29 (FIG. 4) in correspondence to the operators M1, M2, C1 and C2. In the envelope generator 29, upon depression of the key, envelope shape data EV1–EV4 corresponding to the operators M1, M2, C1 and C2 are generated in accordance with the envelope parameter data.

The fine adjustment of the ratio of content of harmonic components in a tone signal by the bright switch B and the mellow switch M and the fine adjustment of the rise characteristics of a tone by the fast switch F and the slow switch S are achieved by controlling the envelope shape data EV1–EV4 corresponding to the respective operators M1, M2, C1 and C2. Particularly, by controlling the envelope shape data EV1–EV4 corresponding to the operators M1, M2, C1 and C2 having regard to whether the operators are functioning as the modulating wave signal generation means or the carrier wave signal generation means in the FM operation formula, the adjustment of the ratio of content of harmonic components in a tone signal and the adjustment of the rise characteristics of a tone can be properly effected. Citing a typical example, increase of the modulation degree increases the ratio of content of harmonic components in an obtained waveshape signal and decrease in the modulation degree decreases the ratio of content of harmonic components. The rise characteristics of a tone are determined receiving most deeply the influence of the tone volume level setting envelope shape. If, accordingly, the ratio of content of harmonic components in a tone signal is to be adjusted, this adjustment may be achieved mainly by adjusting envelope shape characteristics of the envelope shape data in the operators functioning as the modulating wave signal generation means, i.e., envelope shape data functioning as the modulation index setting data, by operating the bright switch B and the mellow switch M. The adjustment of the rise characteristics of a tone may be achieved mainly by adjusting the characteristics of the tone volume level setting envelope shape by operating the fast switch F and the slow switch S.

As is known in the art, the carrier wave phase angle data ωct supplied to the inputs I1 of the operators M1, M2, C1 and C2 is provided in accordance with the tone pitch of a tone to be generated.

Figure 6:
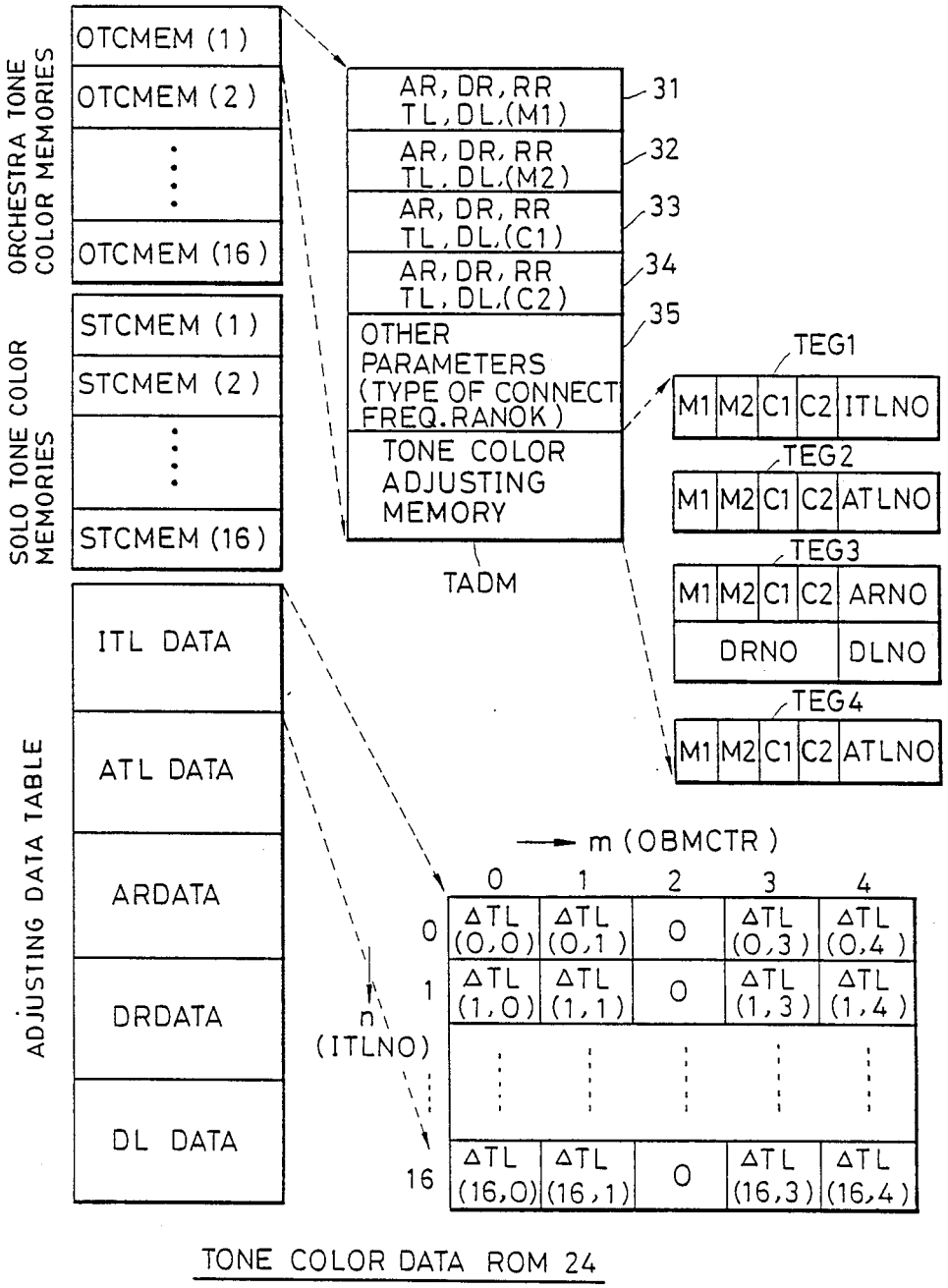
FIG. 6 is a diagram showing an example of contents stored in a tone color data ROM in FIG. 2.

FIG. 6 shows an example of data stored in the tone color data ROM 24. Orchestra tone color memories OTCMEM (1)–OTCMEM(16) store standard tone color data of tone colors corresponding to the orchestra channel tone color selection switches OTC1–OTC16. Solo tone color memories STCMEM(1)–STCMEM(16) store standard tone color data of tone colors corresponding to the solo channel tone color selection switches STC1–STC16.

Memory format of the tone color memory OTCMEM(1) corresponding to the tone color selection switch OTC1 will representatively be described. Memory areas 31 35 are areas for storing standard tone color data. In the memory areas 31, 32, 33 and 34 are stored envelope parameters AR, DR, RR, TL and DL for each of the operators M1, M2, C1 and C2. In the memory area 35 are stored other FM operation parameters (data designating the type of connection of the operators and the frequency ratio setting data k for each of the operators M1, M2, C1 and C2 etc.).

The tone color memory OTCMEM(1) further comprises a tone color adjusting memory TADM. The tone color adjusting memory TADM comprises four memory blocks TEG1–TEG4.

The memory block TEG1 stores data designating an operator in which the envelope shape data functions as the modulation index setting data and index table number ITLNO. More specifically, the memory block TEG1 comprises 4-bit memory positions corresponding to the operators M1, M2, C1 and C2 and 4-bit memory positions for storing the index table number ITLNO. Among the 4-bit memory positions corresponding to the operators M1, M2, C1 and C2, "1" is stored at the memory position corresponding to the operator in which the envelope shape data functions as the modulation index setting data and "0" is stored at the memory position corresponding to the other operator. The index table number ITLNO is data designating a table number to be read out in an index total level adjusting data table ITLDATA.

The memory block TEG2 stores data designating an operator in which the envelope shape data functions as tone volume level setting data and a tone volume level table number ATLNO. More specifically, the memory block TEG2 comprises 4-bit memory positions corresponding to the operators M1, M2, C1 and C2 and 4-bit memory position for storing the tone volume level table number ATLNO. Among the 4-bit memory positions corresponding to the operators M1, M2, C1 and C2, "1" is stored at a memory position corresponding to an operator in which the envelope shape data functions as the tone volume level setting data and "0" is stored at a memory position corresponding to the other operator. The tone volume level table number ATLNO is data designating a table number to be read out in a tone volume total level adjusting data table ATLDATA.

The memory blocks TEG1 and TEG2 are provided for supplying data for the fine adjustment of the rate of content of harmonic components in a tone signal by the bright switch B and the mellow switch M.

The memory block TEG3 stores data designating an operator for finely adjusting the attack rate AR, decay rate DR and decay level DL in the envelope shape and attack rate table number ARNO, decay rate table number DRNO and decay level table number DLNO. More specifically, the memory block TEG3 comprises 4-bit memory positions corresponding to the operators M1, M2, C1 and C2 and 4-bit memory positions for storing table numbers ARNO, DRNO and DLNO. Among the 4-bit memory positions corresponding to the operators M1, M2, C1 and C2, "1" is stored at a memory position corresponding to an operator in which the envelope shape is used for finely adjusting the modulation index setting data and the attack rate AR, decay rate DR and decay level DL of the envelope shape and "0" is stored at a memory position corresponding to the other operator. The attack rate table number ARNO is data designating a table number to br read out in an attack rate adjusting data table ARDATA. The decay rate table number DRNO is data designating a table number to be read out in a decay rate adjusting data table DRDATA. The decay level table number DLNO is data designating a table number to be read out in a decay level adjusting data table DLDATA.

The memory block TEG4 stores, in the same manner as the above described memory block TEG2, data designating an operator in which the envelope shape data functions as the tone volume level setting data and a tone volume level table number ATLNO. The memory block TEG2, however, stores data for the fine adjustment of the ratio of content of harmonic components whereas the memory block TEG4 stores data for the adjustment of the rise characteristics of a tone. Accordingly, the contents stored in the memory block TEG2 and those stored in the memory block TEG4 differ from each other.

The memory blocks TEG3 and TEG4 are provided for supplying data for the fine adjustment of the rise characteristics of a tone by the fast switch F and the slow switch S.

The above is a memory format of the tone color memory OTCMEM(1) corresponding to the tone color selection switch OTC1. It should be noted that memory formats of the tone color memories OTCMEM(2) OTCMEM(16) and STCMEM(1)–STCMEM(16) corresponding to the other tone color selection switches OTC2–OTC16 and STC1–STC16.

The tone color data ROM 24 further comprises an index total level adjusting data table ITLDATA, a tone volume total level adjusting data table ARDATA, an attack rate adjusting data table ARDATA, a decay rate adjusting data table DRDATA and a decay level adjusting data table DLDATA.

By way of example, the index total level adjusting data table ITLDATA stores total level fine adjusting data ΔTL(0,0)–ΔTL(15,4) corresponding to five step fine adjusting steps ranging from 0–4. The total level fine adjusting data ΔTL(n, m) (where n is any one of sixteen index table numbers and m is any one of the five stage fine adjusting steps) is data representing width of change of the envelope shape relative to the standard total level TL. By adding ΔTL(n, m) to TL, the total level of the envelope shape is finely adjusted to TL+ΔTL(n, m) and the envelope shape thereby is variably controlled. In the case where this envelope shape is used as the modulation index data, therefore, the modulation degree of the FM operation is variably controlled and the ratio of content of harmonic components in a tone signal thereby is adjusted.

The index table number n to be read out is designated by the index table number ITLNO of the above described memory block TEG1 and the fine adjustment step m in this index table number n is designated by operation of the bright switch B and the mellow switch M of the tone color adjusting operator means 21 or 23. In other words, one of the five step fine adjustment steps is selected by operation of the bright switch B and the mellow switch M. Initial step is "2" and the fine adjusting data ΔTL (n, 2) at this time is "0". This represents that no change has been made from the standard data. Turning on of the bright switch B increases the step number m and turning on of the mellow switch M decreases the step number m.

Assume, for example, that "1" is stored in the memory block TEG1 in correspondence to the operators M1, M2 and C1, that the index table number ITLNO is "3" and that the fine adjustment step m established by operation of the bright switch B and the mellow switch M is "3". In this case, the total level fine adjusting data ΔTL(3, 3) is read out from the index total level adjusting data table ITLDATA. Respective data read out from the memory areas 31, 32 and 33 corresponding to the operators M1, M2 and C1 are respectively changed (i.e., adjusted) by this total level fine adjusting data TL(3,3).

Formats of the other adjusting data tables ATLDATA, ARDATA, DRDATA and DLDATA are prepared in the same manner as the above described index total level adjusting data table ITLDATA.

The tone volume total level adjusting data table ATLDATA, however, stores total level fine adjusting data ΔTL(0, 0)–ΔTL(15, 4) for tone volume level control corresponding to the five step fine adjustment steps ranging from 0 to 4 in correspondence to sixteen tone volume level table numbers from 0 to 15 (contents of the total level fine adjusting data differ from the total level fine adjusting data stored in the index total level adjusting data table ITLDATA). In the case of finely adjusting the ratio of content of harmonic components, the tone volume level table number n to be read out is designated by the tone volume level table number ATLNO of the above described memory block TEG2 and the fine adjustment step m in this tone volume level table number n is designated by operation of the bright switch B and the mellow switch M of the tone color adjusting operator means 21 or 23. In the case of finely adjusting the rise characteristics of a tone, the tone volume level table number n to be read out is designated by the tone volume level table number ATLNO in the above described memory block TEG4 and the fine adjustment step m in this tone volume level table number n is designated by operation of the bright switch B and the mellow switch M of the tone color adjusting operator means 21 or 23.

The fast switch F and the slow switch S are also adapted to be operated to select any of the five step fine adjustment steps. In this case also, the initial step is "2" and the fine adjustment data selected at this time is "0" representing that no change has been made from the standard data. In the same manner as described before, turning on of the fast switch F increases the step number m and turning on of the slow switch S decreases the step number m.

The attack rate adjusting data table ARDATA stores attack rate fine adjusting data ΔAR(0, 0)–ΔAR(15, 4) corresponding to fine adjustment steps of five steps from 0 to 4 in correspondence to sixteen attack rate table numbers from 0 to 15. The attack rate table number n to be read out is designated by the attack rate table number ARNO of the above described memory block TEG3 and the fine adjusting step m in this attack rate table number n is designated by operation of the fast switch F and the slow switch S of the tone color adjusting operator means 21 or 23. The attack rate fine adjusting data ΔAR(n, m) read out in this way is added to each data of the attack rate AR read out from the memory area (any of 31, 32, 33 and 34) corresponding to an operator (any of M1, M2, C1 and C2) designated by storing "1" in the memory block TEG3 thereby changing (finely adjusting) the attack rate AR.

The decay rate adjusting data table DRDATA stores decay rate fine adjusting data ΔDR(0, 0)–ΔDR(15, 4) corresponding to fine adjustment steps of five steps from 0 to 4 in correspondence to sixteen decay rate table numbers from 0 to 15. The decay rate table number n to be read out is designated by the decay rate table number DRNO of the above described memory block TEG3 and the fine adjustment step m, in this decay rate table number n is designated by operation of the fast switch S and the slow switch S of the tone color adjusting operator means 21 or 23. The decay rate fine adjusting data ΔDR(n, m) read out in this way is added to each data of the decay rate DR read out from the memory area (any of 31, 32, 33 and 34) corresponding to an operator (any of M1, M2, C1 and C2) designated by storing "1" in the memory block TEG3 thereby changing (finely adjusting) the decay rate DR.

The decay level adjusting data table DLDATA stores decay level fine adjusting data ΔDL(0, 0)–ΔDL(15, 4) corresponding to fine adjustment steps of five steps from 0 to 4 in correspondence to sixteen decay level table numbers from 0 to 15. The decay level table number n to be read out is designated by the decay level table number DLNO of the above described memory block TEG3 and the fine adjustment step m in this decay level table number n is designated by the fast switch F and the slow switch S of the tone color adjusting operator means 21 or 23. The decay level fine adjusting data ΔDL(n, m) read out in this manner is added to each data of the decay level DL read out from the memory area (any of 31, 32, 33 and 34) corresponding to an operator (any of M1, M2, C1 and C2) designated by storing "1" in the memory block TEG3 thereby changing (finely adjusting) the decay level DL.

Various processings including the key scanning operation for detecting depression and release of keys in the keyboard 14, key assigning operation, scanning for detecting operations of switches etc. in the operation panel section 16 and turning on and off of LEDs, generation of information concerning depressed keys and tone control information and supplying of such information to the tone signal generation circuit 15 are implemented by the microcomputer.

An example of a flow chart of processings relating to the present invention among processings implemented by the microcomputer is shown in FIGS. 8 through 11. An example of contents stored in the data and working RAM 3 used in connection with these processings is shown in FIG. 7.

Orchestra system selected tone color number OTCNO is number data representing a tone color selected in the orchestra system indicating operated one of orchestra system tone color selection switches OTC-1–OTC16.

An orchestra system bright/mellow counter OBMCTR is counted up and down in accordance with operation of the bright switch B and the mellow switch M and its count indicates the above described fine adjusting step m of five steps. The initial set value of this counter OBMCTR is "2" corresponding to the initial step and the count increases by 1 each time the bright switch B of the orchestra system tone color adjusting operator means 21 is turned on whereas the count decreases by 1 each time the mellow switch M of the orchestra system tone color adjusting operator means 21 is turned on.

An orchestra system fast/slow counter OFSCTR is counted up and down in accordance with operation of the fast switch F and the slow switch S and its count represents the above described fine adjusting step m. The initial set value of this counter OFSCTR is "2" corresponding to the initial step and the count value increases by 1 each time the fast switch F of the orchestra system tone color adjusting operator means 21 is turned on whereas the count value decreases by 1 each time the slow switch S of the orchestra system tone color adjusting operator means 21 is turned on.

Orchestra data ORCON becomes "1" when the orchestra system can generate a tone and "0" when the orchestra system cannot generate a tone. The orchestra 0N display light-emitting diode 20 (FIG. 2) is lighted when this orchestra ON data ORCON is "1" and extinguished when the orchestra ON data ORCON is "0". In the "orchestra system" in the tone signal generation circuit 15, generation of a tone signal is permitted when this orchestra ON data ORCON is "1" and it is prohibited when this data ORCON is "0". The prohibition of generation of a tone signal includes processing for stopping sounding of a tone signal which is being sounded.

An orchestra system tone color data buffer memory OBUFM stores tone color data of a tone which is currently established in the orchestra system . The type of tone color data stored therein corresponds to the type of data stored in the memory areas of the respective tone color memories OTCMEM(1)–STCMEM(16) of FIG. 6. The tone color data stored in this orchestra system tone color data buffer memory OBUFM is supplied to the tone signal generation circuit 15 for setting the tone color of the tone signal to be generated in the orchestra system.

Solo system selected tone color number STCNO is number data representing a tone color selected in the solo system and indicates operated one of the solo L system tone color selection switches STC1–STC16.

A solo system bright/mellow counter SBMCTR is counted up and down by operation of the bright switch B and the mellow switch M of the solo system tone color adjusting operator means 23. The initial set value of this counter SBMCTR is "2" corresponding to the initial step and the count increases by 1 each time the bright switch B of the solo system tone color adjusting operator means 21 is turned on whereas the count decreases by 1 each time the mellow switch M of the solo system tone color adjusting operator means 21 is turned on.

A solo system fast/slow counter SFSCTR is counted up and down in accordance with operation of the fast switch F and the slow switch S of the solo system tone color adjusting operator means 23. The initial set value of this counter SFSCTR is "2" corresponding to the initial step and the count increases by 1 each time the fast switch F of the solo system tone color adjusting operator means 21 is turned on whereas the count decreases by 1 each time the slow switch S of the solo system tone color adjusting operator means 21 is turned on.

Solo ON data SOLON becomes "1" when the solo system can generate a tone and "0" when the solo system cannot generate a ton. The solo ON display light-emitting diode 22 (FIG. 2) is lighted when the solo ON data SOLON is "1" and extinguished when the solo ON data SOLON is "0". In the "solo system" in the tone signal generation circuit 15, generation of a tone signal is permitted when this solo ON data SOLON is "1" and it is prohibited when the data SOLON is "0".

A solo system tone color data buffer memory SBUFM stores tone color data of a tone which is currently established in the solo system. The type of tone color data stored therein corresponds to the type of data stored in the memory areas 31–35 of the respective tone color memories OTCMEM(1)–STCMEM(16) of FIG. 6. The tone color data stored in this solo system tone color data buffer memory SBUFM is supplied to the tone signal generation circuit 15 for setting the tone color of the tone signal to be generated in the solo system .

An area for storing the above described data or signal is provided in the data and working RAM 13. Provided also in the data and working RAM 13 are an area for storing key data of keys assigned to respective tone generation channels of the tone signal generation circuit 15 (including key codes and key-on signal which are obtained by the key assigning operation), an area for storing data of detecting operations of the switches etc. and on/off data of LEDs etc. in the operation panel section 16, and other working areas.

The main routine of FIG. 8 will now be described.

In "tone color related switch scanning processing", a scanning processing for detecting operations of the respective switches and operator means in the orchestra system tone color selection section 17 and the solo system tone color selection section 18 is performed. In "other panel operator scanning processing", a scanning processing for detecting operations of the respective switches and operators in the other operator section 19 in the operation panel section 16.

In "key scanning processing", a processing for detecting on/off states of the respective keys in the keyboard 14 is performed. This processing includes a processing for assigning a new key corresponding to a new key-on and a processing for cancelling assignment of a key corresponding to a new key-off. An example of relation between the orchestra and solo systems and the tone generation channels is that there are eight tone generation channels for the orchestra system enabling simultaneous sounding of eight tones at the maximum whereas there is one tone generation channel for the solo system enabling sounding of a single solo tone. Tones corresponding to plural depressed keys are assigned to the tone generation channels for the orchestra system One key among the plural depressed keys to be assigned to the tone generation channels for the orchestra system is preferentially selected (on the basis of, e.g., higher tone or later arrived tone) and this preferentially selected tone is assigned to the tone generation channel for the solo system . The key data and key-on and key-off signals of the keys assigned to the respective tone generation channels in this manner are supplied to the tone signal generation circuit 15 at proper timings.

Figures 8, 9:
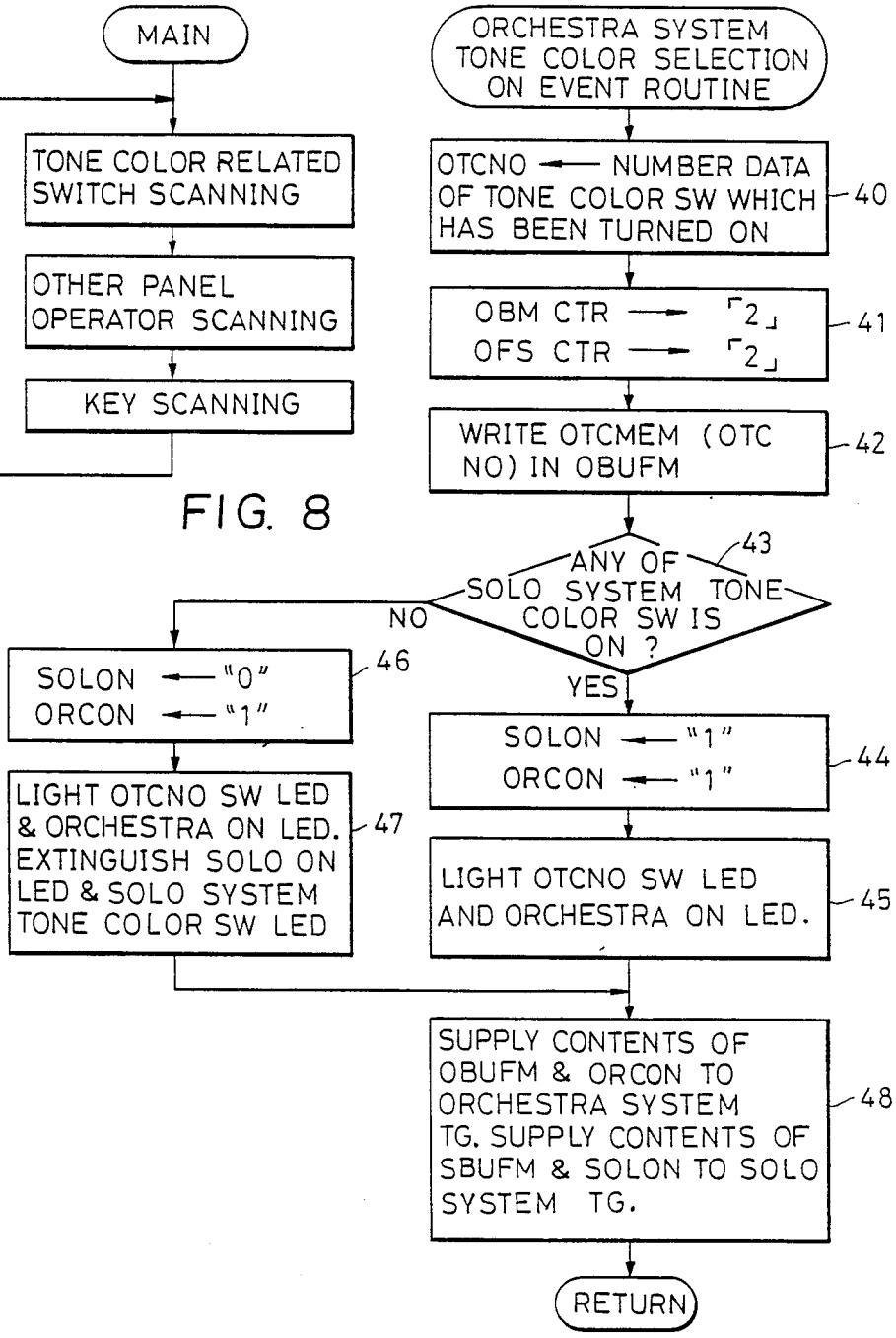
FIG. 8 is a flow chart schematically showing a main routine of processings executed by a microcomputer in FIG. 2.
FIG. 9. is a flow chart showing an example of orchestra system tone color selection ON event routine.
Figure 10:
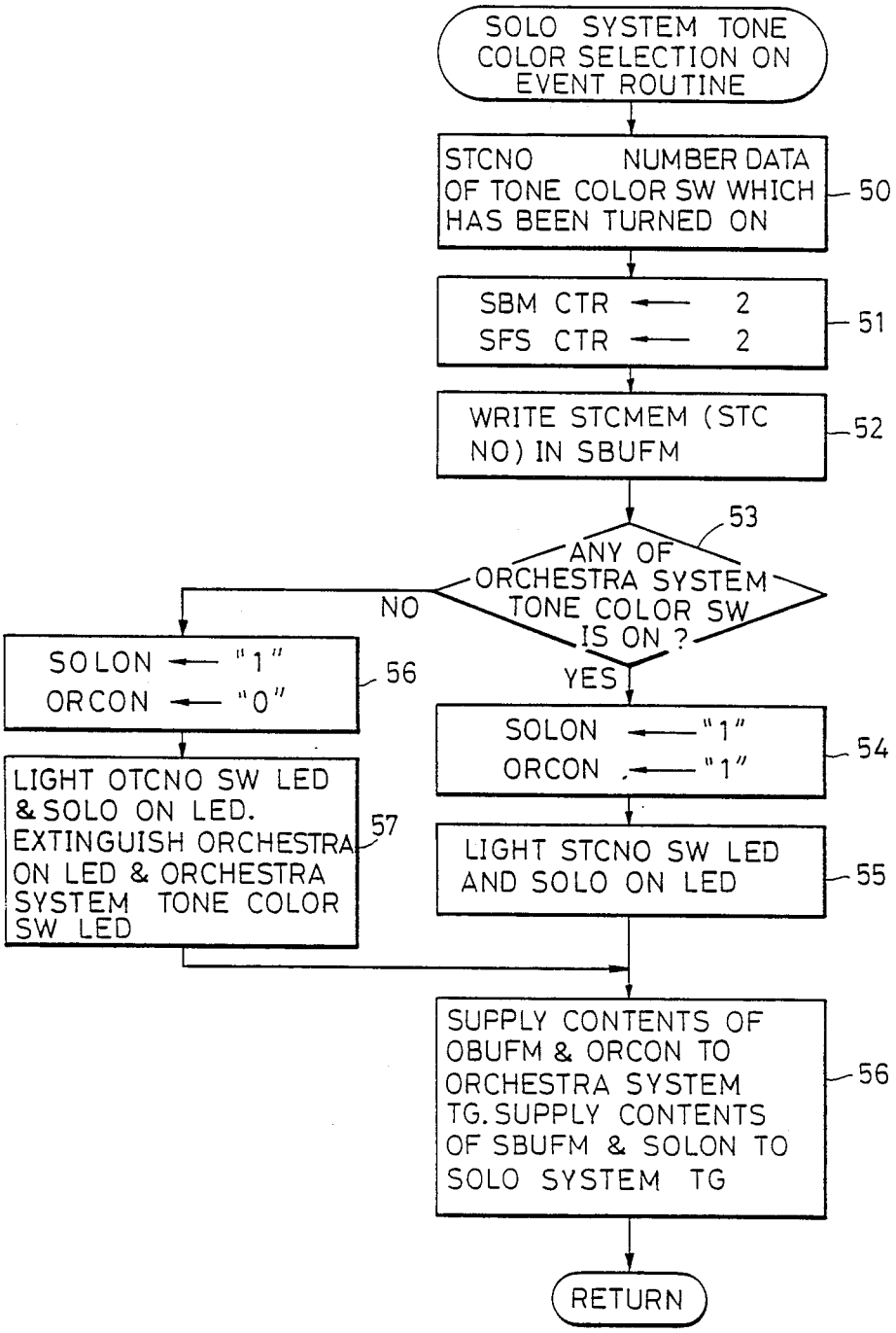
FIG. 10 is a flow chart showing an example of solo system tone color selection ON event routine.
Figure 11:
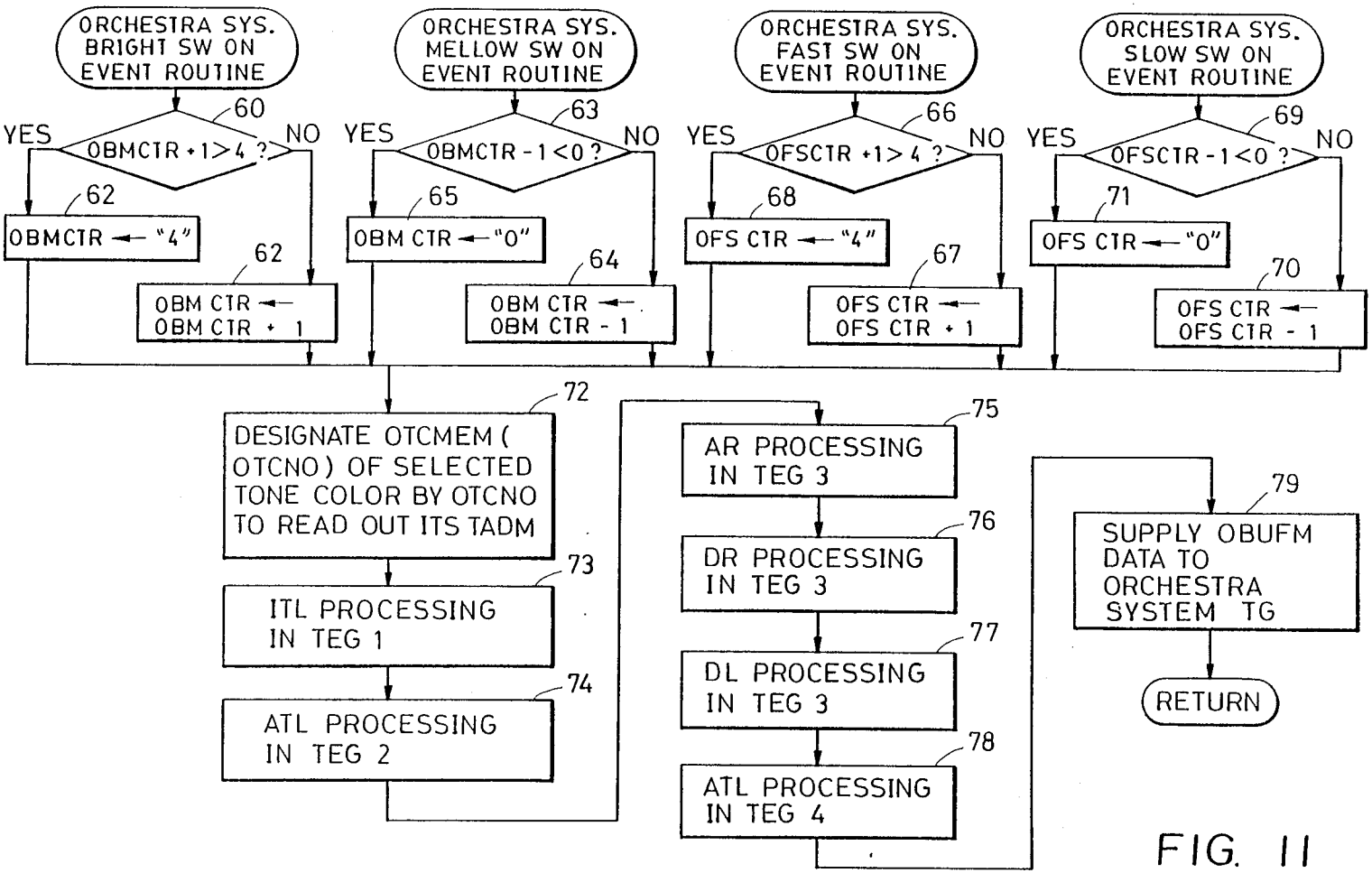
FIG. 11 is a flow chart showing an example of switch ON event routine of an orchestra system tone color adjusting operator means.

If operation of a switch has been detected in "tone color related switch scanning processing", processings shown in FIGS. 9–11 are executed.

Upon turning on of any of the orchestra system tone color selection switches OTC1–OTC16, "orchestra system tone color selection ON event routine" is executed. In step 40, number data corresponding to one of the orchestra system tone color selection switches OTC1–OTC16 which has been turned on is stored as orchestra system selected tone color number OTCNO. In next step 41, counts of the orchestra system bright/-mellow counter OBMCTR and orchestra system fast/s-low counter OFSCTR are set to the initial value "2".

In next step 42, standard tone color data (stored in the memory areas 31–35) which is stored in a memory (designated by OTCMEM(OTCNO)) corresponding to the orchestra system selected tone color number OTCNO among the orchestra tone color memories OTC-MEM(1) OTCMEM(16) is written in the orchestra system tone color data buffer memory OBUFM.

In next step 43, whether or not any of the solo system tone color selection switches STC1–STC16 is 0N simultaneously with any of the orchestra system tone color selection switches OTC1–OTC16 is examined. In a case where the tone color selection operation has been made both in the solo system and the orchestra system substantially simultaneously, the processing proceeds to step 44 in which the solo ON data SOLON and the orchestra ON data ORCON are both set to "1". In next step 45, the orchestra ON display LED 20 (FIG. 2) is lighted in response to "1" of the orchestra ON data ORCON and the LED corresponding to one of the orchestra channel tone color selection switches OTC-1–OTC16 which has been turned on in response to the orchestra system selected tone color number OTCNO is lighted.

In a case where the tone color selection operation has not been made in the solo system , the processing proceeds to step 46 in which the solo ON data SOLON is reset to "0" and the orchestra ON data ORCON is set to "1". In next step 47, the orchestra ON display LED 20 (FIG. 2) is lighted in response to "1" of the orchestra ON data ORCON and the LED corresponding to one of the orchestra system tone color selection switches OTC1 OTC16 which has been turned on in response to the orchestra system selected tone color number OTCNO is lighted. The solo ON display LED 22 (FIG. 2) is extinguished in response to "0" of the solo ON data SOLON.

In step 48, the tone color data stored in the orchestra system tone color data buffer memory OBUFM and the contents of the orchestra ON data ORCON are supplied to the orchestra system in the tone signal generation circuit 15. The tone color data stored in the solo system tone color data buffer memory SBUFM and the contents of the solo ON data SOLON are supplied to the solo system in the tone signal generation circuit 15. In the orchestra system and the solo system in the tone signal generation circuit 15, tone signals having tone colors corresponding to the tone color data supplied thereto are formed. If the orchestra ON data ORCON and the solo ON data SOLON corresponding to the respective systems are "1", the corresponding system can generate a tone whereas if these data are "0", the corresponding system cannot generate a one.

In this case, the contents of the orchestra ON data ORCON are "1" so that the orchestra system can generate a tone. The contents of the solo ON data SOLON are "1" when the processing proceeded through steps 44 and 45 and the solo system can generate a tone whereas they are "1" when the processing proceeded through steps 46 and 47. If, accordingly, a tone color selection operation for generating a tone of a desired tone color in the orchestra system is performed when a tone is being generated in the solo system, the generation of the tone in the solo system is stopped by this tone color selection operation alone without a particular operation for cutting off the generation of the tone in the solo system . If tones are to be generated in both the solo system and the orchestra system , the tone color selection operation may be made substantially simultaneously in both systems.

When any of the solo system ton color selection switches STC1–STC16 is turned on, "solo system tone color selection ON event routine" is executed. The contents of processing of this routine are substantially the same as those of the above described "orchestra system tone color selection ON event routine" of FIG. 9 except that data and memories used are those for the solo system More specifically, in step 50, number data corresponding to one of the solo system tone color selection switches STC1–STC16 which has been turned on is stored as the solo system selected tone color number STCNO. In next step 51, counts of the solo channel bright/mellow counter SBMCTR and the solo system fast/slow counter SFSCTR are set to the initial value "2".

In next step 52, standard tone color data stored in a memory corresponding to the solo system selection tone color number STCNO (designated by STCMEM(STCNO)) among the solo tone color memories STCMEM(1) STCMEM(16) is written in the solo system tone color data buffer memory SBUFM.

In next step 53, whether or not any of the orchestra system tone color selection switches OTC1 OTC16 is ON simultaneously with any of the solo system tone color selection switches STC1–STC16 is examined.

If the tone color selection operation has been made substantially simultaneously in the solo system and the orchestra system , the processing proceeds to step 54 in which the solo ON data SOLON and the orchestra ON data ORCON are both set to "1". In next step 55, the solo 0N display LED 22 (FIG. 2) is lighted in response to "1" of the solo ON data SOLON and the LED corresponding to one of the solo system tone color selection switches STC1 STC16 which has been turned on in response to the solo system selected tone color number STCNO is lighted.

If the tone color selection operation has not been made in the orchestra system , the processing proceeds to step 56 in which the orchestra ON data ORCON is reset to "0" and the solo ON data SOLON is set to "1". In next step 57, the solo ON display LED 22 is lighted in response to "1" of the solo ON data SOLON and the LED corresponding to one of the solo system tone color selection switches STC1–STC16 which has been turned on in response to the solo system selected tone color number STCNO. The orchestra ON display LED 20 (FIG. 2) is extinguished in response to "0" of the orchestra 0N data ORCON.

In step 58, the tone color data stored in the solo system tone color data buffer memory SBUFM and the contents of the solo ON data SOLON are supplied to the solo system in the tone signal generation circuit 15. The tone color data stored in the orchestra system tone color data buffer memory OBUFM and the contents of the orchestra ON data ORCON are supplied to the orchestra system in the tone signal generation circuit 15.

In this case, the contents of the solo ON data SOLON are "1" and the solo system can generate a tone. The contents of the orchestra ON data ORCON are "1" when the processing has proceeded through steps 54 and 55 so that the orchestra system can generate a tone whereas they are "0" when the processing has proceeded through steps 56 and 57 so that the orchestra system cannot generate a tone. If, accordingly, the tone color selection operation is made for generating a tone of a desired tone color in the solo system when a tone is being generated in the orchestra system , the generation of the tone in the orchestra system can be stopped by the tone color selection operation alone without a particular operation for cutting off generation of the tone in the orchestra system If tones are to be generated in both the solo system and the orchestra system , the tone color selection operation may be made substantially simultaneously in both systems in the same manner as described above.

If the orchestra system tone color adjusting operator means 21 is operated, the routine of FIG. 11 is executed.

Upon turning on of the bright switch B of the orchestra system tone color adjusting operator means 21, processing of bright switch ON evnet routine is performed. In this routine, whether or not a value obtained by adding 1 to the contents of the orchestra system bright/mellow counter OBMCTR is larger than the maximum count "4" is examined (step 60). If this value has not exceeded the maximum count "4", the contents of the counter OBMCTR are renewed by a value (OBMCTR . 1) obtained by adding 1 to the contents of the counter OBMCTR (step 61). If this value has exceeded the maximum count "4", the contents of the counter OBMCTR are fixed to the maximum count "4" (step 62). Then, the processing proceeds to step 72.

If the mellow switch M of the orchestra system tone color adjusting operator means 21 has been turned on, a processing of mellow switch ON event routine is executed. In this routine, whether or not a value obtained by subtracting 1 from the contents of the orchestra system bright/mellow counter BMCTR is smaller than the minimum count "0" of this counter is examined (step 63). If this value is not smaller than the minimum count "0", the contents of the counter OBMCTR are renewed by a value (OBMCTR-1) obtained by subtracting 1 from the contents of the counter OBMCTR (step 64). If this value is smaller than the minimum count "0", the contents of the counter OBMCTR are fixed to the minimum count "0" (step 65). Then the processing proceeds to step 72.

If the fast switch F of the orchestra system tone color adjusting operator means 21 has been turned on, a processing of fast switch ON event routine (steps 66–68) is executed. In this routine, the same processing as the above described bright switch ON event routine (steps 60–62) is performed with respect to the orchestra system fast/slow counter OFSCTR. More specifically, the processing of increasing the count of this counter OFSCTR up to the maximum count "4" is performed. Then the processing proceeds to step 72.

If the slow switch S of the orchestra system tone color adjusting operator means 21 is turned on, a processing of slow switch ON event routine (steps 69–71) is executed. In this processing, the same processing as in the above described mellow switch 0N (steps 63–65) is performed with respect event routine to the orchestra system fast/slow counter OFSCTR. In other words, the count of the counter OFSCTR is decreased to the minimum limit of "0". Then the processing proceeds to step 72.

In an initial stage in which a certain standard tone color has been selected by one of the orchestra system tone color selection switches OTC1–OTC16, the counts of the orchestra system bright/mellow counter OBMCTR and the orchestra system fast/slow counter OFSCTR are respectively set to "2" by the processing of step 41 of FIG. 9. By operating the switches B, M, F and S of the orchestra system tone color adjusting operator means 21, the contents of the counters OBMCTR and OFSCTR are increased or decreased from the initial value "2".

In next step 73 ("ITL processing in TEG1"), operator designation data designating operator (M1, M2, C1 or C2) functioning as the modulation index setting data and index table number ITLNO are read out from the memory block TEG1 (FIG. 6) of the tone color adjusting memory TADM which has been designated in the preceding step. Standard data of the total level TL is read out from the memory area corresponding to the operator designated by the operator designation data (any of the operators M1, M2, C1 and C2 in which the operator designation data is "1", hereinafter referred to as "designated operator") among the memory areas 31–34 (see FIG. 6) in the tone color memory OTCMEM(OTCNO) corresponding to the selected tone color. The total level fine adjusting data $\Delta TL(n, m)$ is read out from the index total level adjusting data table ITLDATA in accordance with the index table number ITLNO and the contents of the orchestra system bright/mellow counter OBMCTR. As described above, the index table number n to be read out is designated by the index table number ITLNO and the step m to be read out in the fine adjustment step of five steps is designated by the count of the orchestra system bright/mellow counter OBMCTR. An operation for adding the total level fine adjusting data $\Delta TL(n, m)$ to each total level TL of the "designated operator" is performed. The fine adjusting data is affixed with a positive or negative sign. The result of the addition "TL+TL(n, m)" for each "designated operator" is stored in the orchestra system tone color data buffer memory OMUFM. In the orchestra system tone color data buffer memory OBUFM, the contents of the total level TL for each "designated operator" stored till then is renewed by the result of the addition "TL+TL(n, m)" corresponding to the "designated operator".

In next step 74 ("ATL processing in TEG2"), the same processing as the above described "ITL processing in TEG1" in step 73 is performed with respect to data of total level TL for setting tone volume level. More specifically, operator designation data designating any of the operators M1, M2, C1 and C2 functioning as the tone volume level setting data and the tone volume level table number ATLNO are read out from the memory block TEG2 (FIG. 6) in the tone color adjusting memory TADM which has been designated in the preceding step 72. Standard data of the total level TL is read out from the memory area corresponding to the operator designated by the operator designation data (any of the operators M1, M2, C1 and C2 in which the operator designation data is "1", hereinafter referred to as "designated operator") among the memory areas 31-34 (see FIG. 6) in the tone color memory OTCMEM(OTCNO) corresponding to the selected tone color The total level fine adjusting data ATL(n, m) for controlling tone volume level is read out from the tone volume total level adjusting data table ATLDATA in accordance with the tone volume level table number ATLNO and the contents of the orchestra system bright/mellow counter OBMCTR. An operation for adding the total level fine adjusting data ΔTL(n, m) to each standard total level TL of the "designated operator" is performed. The result of the addition "TL+ΔTL(n, m)" for each "designated operator" is stored in the orchestra system tone color data buffer memory OBUFM. In the orchestra system tone color data buffer memory OBUFM, the contents of the total level TL for each "designated operator" stored till then is renewed by the result of the addition "TL+ΔTL(n, m)" corresponding to the "designated operator".

In next step 75 (AR processing in TEG3), a processing which is substantially the same as the above described "ITL processing in TEG1" in step 73 is performed with respect to the attack rate AR. In this processing, however, the orchestra system fast/slow counter OFSCTR is used instead of the orchestra system bright/mellow counter OBMCTR. More specifically, operator designation data designating any of the operators M1, M2, C1 and C2 for finely adjusting the attack rate AR and the attack rate table number ARNO are read out from the memory block TEG3 (FIG. 6) of the tone color adjusting memory TADM which has been designated in the preceding step 72. Standard data of the attack rate AR is read out from the memory area corresponding to the operator designated by the operator designation data (any of the operators M1, M2, C1 and C2 in which the operator designation data is "1", i.e., "designated operator") among the memory areas 31-34 (see FIG. 6) in the tone color memory OTCMEM(OTCNO) corresponding to the selected tone color. The attack rate fine adjusting data ΔAR(n, m) is read out from the attack rate adjusting data table ARDATA in accordance with the attack rate table number ARNO and the contents of the orchestra system fast/slow counter OFSCTR. An operation for adding the attack rate fine adjusting data ΔAR(n, m) to the standard attack rate AR of the "designated operator" is performed. The result of the addition "TL+ΔTL(n, m)" for each "designated operator" is stored in the orchestra system tone color data buffer memory OBUFM. In the orchestra system tone color data buffer memory OBUFM, the contents of the attack rate AR for each "designated operator" stored till then are renewed by the result of the addition "TL+ΔTL(n, m)" corresponding to the "designated operator".

In next step 76 ("DR processing in TEG3") and step 77("DL processing in TEG3"), a processing which is substantially the same as the above described "AR processing in TEG3" in step 75 are performed with respect to the decay rate ΔDR and the decay level DL. In step 76, the decay rate fine adjusting data ΔDR(n, m) is read out from the decay rate adjusting data table DRDATA in accordance with the decay rate table number DRNO and the contents of the orchestra system fast/slow counter OFSCTR. The decay rate fine adjusting data ΔDR(n, m) is added to standard decay rate DR of "designated operator" and the corresponding contents of the orchestra system tone color data buffer memory OBUFM are renewed by the result of the addition "TL . ΔTL(n, m)" for each "designated operator". In step 77, the deacy level fine adjusting data ΔDL(n, m) is read out from the decay level adjusting data table DLDATA in accordance with the decay level table number DLNO in TEG3 and the contents of the orchestra system fast/slow counter OFSCTR. The decay level fine adjusting data ΔDL(n, m) is added to standard decay level DL for each "designated operator" and the corresponding contents of the orchestra system tone color data buffer memory OBUFM are renewed by the result of the addition "TL+ΔTL(n, m)" for each "designated operator".

In next step 78 ("ATL processing in TEG4"), a processing which is almost the same as the above described "ATL processing in TEG2? in step 74 is performed with respect to data of the total level TL for setting tone volume level. However, in this processing which is one for adjusting the rise characteristics of a tone, the orchestra system fast/slow counter OFSCTR is used instead of the orchestra system bright/mellow counter OBMCTR. In this step 78, the total level fine adjusting data ΔTL(n, m) for controlling tone volume level is read out from the tone volume total level adjusting data table ATLDATA in accordance with the tone volume level table number ATLNO of TEG4 and the contents of the orchestra system fast/slow counter OFSCTR. The total level fine adjusting data ΔTL(n, m) is added to the standard total level TL for each "designated operator" and the corresponding contents of the orchestra system tone color data buffer memory OBUFM are renewed by the result of the addition "TL+ΔTL(n, m)".

In next step 79, various tone color data which are stored in the orchestra system tone color data buffer memory OBUFM and have already been finely adjusted are supplied to the orchestra system in the tone signal generation circuit 15 whereby the tone color of the tone signal generated in the orchestra system is set to a finely adjusted tone color.

The foregoing description has been made with respect to processings performed when the orchestra system tone color adjusting operator means 21 has been operated. In the case of operating the solo system tone color adjusting operator means 23, processings are made in accordance with a program similar to the one described with reference to FIG. 11. In this case, instead of memories and data for the orchestra system, memories and data for the solo system , e.g., solo tone color memories STCMEM(1)-STCMEM(16), solo system bright/mellow counter SBMCTR, solo system fast/slow counter SFSCTR, solo system tone color data buffer memory SBUFM and solo system selection tone color number STCNO, are used.

In this invention, the first and second tone generation systems are not limited to the orchestra system and the solo system . as described in the foregoing embodiment but any other systems. may be employed. For example, the first and second tone generation systems may both generate plural tone signals. Alternatively, the first and second tone generation systems may both generate a single tone. Even if tone signals generated in the two tone generation systems are based on the same depressed key, their tone pitch frequencies may differ from each other in octave. In other words, the first tone generation system and the second tone generation system may generate tone signals with different footage systems.

The tone synthesis system used in the tone generation circuit is not limited to the FM operation system as in the above described embodiment but any other system such as the amplitude modulation operation system, waveshape memory accessing system and harmonics synthesis system, may be employed. In the case a tone synthesis system other than the FM operation system is used, the tone color control elements for finely adjusting the tone color are not limited to the envelope shape data as used in the above described embodiment but tone color control elements which are suited to the tone synthesis system employed may be used. If, for example, the waveshape memory accessing system is employed, data for selecting a waveshape memory storing a finely adjusted desired tone waveshape or parameter for changing the shape of read out waveshape data (e.g., interpolation coefficient and filter coefficient) may be used as the tone color control elements for finely adjusting the tone color. If, again, the harmonics synthesis system is employed, harmonic coefficient may be used as the tone color control element. The data controlled by operation of the tone color adjusting operators is not limited to envelope shape data as uded in the above described embodiment but data of suitable tone color control elements may be used.

In the above described embodiment, for controlling the envelope shape, fine adjusting data consisting of data representing width of change relative to standard data of respective parameters (e.g., attack rate, total level etc.) for establishing the envelope shape is generated by operating the tone color adjusting operator and adjusted parameters are obtained by performing operation between the standard data and this data representing width of change , i.e., fine adjustment data. Instead of performing such operation, however, adjusted parameter may be obtained by prestoring a large number of adjusted parameters in a memory and reading out these adjusted parameters from the memory.

In the tone color data ROM shown in FIG. 6, the adjusting data tables ITLDATA, ATLDATA, ARDATA, DRDATA and DLDATA are shared commonly for the respective tone colors. Alternatively, however, there may be provided adjusting data tables peculiar to the respective tone colors (i.e., for each of the tone color data memories OTCMEM(1)–STCMEM(16)).

The means and steps for generating various fine adjusting data by operation of the tone color adjusting operators are not limited to those used in the above described embodiment.

The above described processings may be carried out not only by the software processings but also by an exclusive hardware circuit.

The contents of the bright/mellow counters OBMCTR and SBMCTR and the fast/slow counters OFSCTR and SFSCTR, i.e., data representing state of the bright/mellow adjustment and state of the fast/slow adjustment, may be visually displayed as required.

Tones to which the tone color control and adjustment of the invention is applied are not limited to scale note tones but include rhythm sounds and other sounds.

In the above described embodiment, the orchestra system tone color adjusting operator means 21 and the solo system tone color adjusting operator means 23 are separately provided. Alternatively, single tone color adjusting operator means may be shared by the two tone generation systems .

In the above described embodiment, the four switches B, M, F and S are provided for one tone color adjusting operator. Alternatively, two switches B and M (or F and S) which constitute a pair only may be provided in correspondence to a common operator (key top).

In the above described embodiment, both the bright/-mellow adjustment and the fast/slow adjustment are used as the tone color adjusting elements. Alternatively, either one of them or other type of tone color adjusting element may be used.

According to the invention, whether a tone signal can be generated or not in a tone generation system corresponding to tone color selection means and in other tone generation system is controlled in association with a tone color selection operation of the tone color selection means. Accordingly, provision of a tone sounding selection switch for each tone generation system can be obviated so that the structure of the circuit can be simplified and the operation for selecting whether a tone signal can be generated or not in each tone generation system can be readily made even during performance of music.

Further, according to the invention, since operation data for finely adjusting a tone color can be formed simply by indicating the direction of relative fine adjustment by the first and second operators, an accurate control of the operation position of the operators is not required but operation of a corresponding one of the operators in the direction in which the fine adjustment should be made will suffice. This greatly facilitates the operation for finely adjusting the tone color so that the operation for finely adjusting the tone color may be readily made even during performance of music.

What is claimed is:

1. A tone control device for an electronic musical instrument comprising:

tone color selection means for selecting a tone color of a tone to be generated;

tone color parameter generation means for generating at least one tone color parameter for realizing the tone color selected by said tone color selection means;

tone signal generation means for generating, in accordance with given tone pitch information and said at least one tone color parameters, a tone signal corresponding to this tone pitch information with a tone color established by said at least one tone color parameter;

first operator means for designating a fine adjustment in a predetermined direction with respect to a predetermined tone color determining element;

second operator means for designating a fine adjustment in a direction opposite to said direction with respect to said predetermined tone color determining element;

operation data forming means for forming operation data concerning said predetermined tone color determining element in response to operation of said first and second operator means; and control means for changing, in accordance with the operation data formed by said operation data forming means, a tone color parameter associated with said predetermined tone color determining element among said at least one tone color parameter generated by said tone color parameter generation means.

2. A tone control device for an electronic musical instrument as defined in claim 1 wherein said predetermined tone color determining element is a ratio of content of harmonic component and said first and second operator means are provided for designating fine adjustment of this ratio of content of harmonic components.

3. A tone control device as defined in claim 1 wherein said predetermined tone color determining element is rise characteristics of the tone and said first and second operator means are provided for designating the rise characteristics.

4. A tone control device as defined in claim 1 wherein said operation data forming means comprises counter means which upcounts in accordance with operation of one of said first and second operator means and forms said operation data in accordance with count of said counter means.

5. A tone control device as defined in claim 1 wherein said control mans generates, in accordance with the operation data formed by said operation data forming means, change width data which increases or decreases the tone color parameter associated with said predetermined tone color determining element among the tone color parameters generated by said tone color parameter generation means, and performs operation for changing the tone color parameter associated with said predetermined tone color determining element among standard tone color parameters corresponding to the selected tone color.

6. A tone control device as defined in claim 1 wherein said first and second operator means have a common operator head, said first operator means being operated by operating one end of said operator head and said second operator means being operated by operating the other end of said operator head.

7. An electronic musical instrument comprising:

a first tone generation system generating, in accordance with one or more given tone pitch information, a tone signal or signals corresponding to the tone pitch information;

a second tone generation system generating, in accordance with one or more given tone pitch information, a tone signal or signals corresponding to the tone pitch information;

first tone color selection means for selecting a tone color of a tone signal generated by said first tone generation system :

second tone color selection means for selecting a tone color of a tone signal generated by said second tone generation system operation detection means for detecting, in response to an output of said respective tone color selection means, (a) whether or not a tone color selection operation has been made substantially simultaneously in both said first and second tone color selection means and (b) whether or not a tone color selection operation has been made only in one of said first and second tone color selection means; and operation detection means for (a) enabling both said first and second tone generation systems to generate a tone when the tone color selection operation has been made substantially simultaneously both in said first and second tone color selection means and, (b) enabling only one of said first and second tone generation systems corresponding to the tone color selection means in which the tone color selection operation has been made to generate a tone and prohibiting the other tone generation system from generating a tone when the tone color selection operation has been made in only one of said first and second tone color selection means.

8. An electronic musical instrument as defined in claim 7, wherein said first and second tone color selection means are disposed side by side.

9. A tone control device as defined in claim 1 wherein the tone color parameter generation means generates plural tone color parameters.

10. A tone control device for an electronic musical instrument comprising:

tone color selection means for selecting a tone color of a tone to be generated;

tone color parameter generation means for generating tone color parameters for realizing the tone color selected by said tone color selection means;

tone signal generation means for generating, in accordance with given tone pitch information and the tone color parameters, a tone signal corresponding to this tone pitch information with a tone color established by the tone color parameters;

a first operator for specifying fine adjustment having a predetermined first tendency with respect to a predetermined tone characteristic;

a second operator for specifying fine adjustment in a second tendency opposite to said first tendency with respect to said predetermined tone characteristic;

operation data forming means for forming operation data concerning said predetermined tone characteristic in response to operation of said first and second operator means; and control means for changing, in accordance with the operation data formed by said operation data forming means, a tone color parameter associated with said tone characteristic among tone color parameters generated by said tone color parameter generation means.

11. A tone control device according to claim 10 wherein the tone characteristic is a ratio of harmonic components of the tone to be generated and wherein the predetermined tendency of the first operator is toward a ratio which provides a relatively bright tone and the predetermined tendency of the second operator is toward a ratio which provides a relatively mellow tone.

12. A tone control device for an electronic musical instrument comprising:

tone color selection means for selecting a tone color of a tone to be generated;

tone color parameter generation means for generating tone color parameters for realizing the tone color selected by said tone color selection means;

tone signal generation means for generating, in accordance with given tone pitch information and the tone color parameters, a tone signal corresponding to this tone pitch information with a tone color established by the tone color parameters;

first operator means for designating a fine adjustment in a predetermined direction with respect to a predetermined tone color determining element;

second operator means for designating a fine adjustment in a direction opposite to said direction with respect to said predetermined tone color determining element; and control means for changing, in accordance with the operation of the first or second operator means, a tone color parameter associated with said predetermined tone color determining element among the tone color parameters generated by said tone color parameter generation means.

13. A control device for an electronic musical instrument comprising:

tone parameter generation means for generating tone parameters for realizing a tone having a desired characteristics;

tone signal generation means for generating, in accordance with given tone pitch information and the tone parameters, a tone signal corresponding to the tone pitch information and having characteristics established by the tone parameters;

a first operator specifying fine adjustment of a predetermined first tendency with respect to at least one predetermined tone characteristic;

a second operator specifying fine adjustment of a second tendency opposite to the first tendency with respect to said at least one predetermined tone characteristic; and control means for changing, in accordance with the operation of the first or second operator, at least one tone parameter associated with said at least one predetermined tone characteristic.

14. A control device as defined in claim I3 wherein the desired characteristics include tone color and wherein the control means changes at least one tone parameter associated with tone color.

15. A control device as defined in claim 14 wherein the first tendency is toward an increase in harmonic components and the second tendency is toward a decrease in harmonic components.

* * * * *